US007059597B2

(12) United States Patent
Shirakura et al.

(10) Patent No.: US 7,059,597 B2
(45) Date of Patent: Jun. 13, 2006

(54) SHEET FEEDING APPARATUS AND IMAGE FORMING APPARATUS

(75) Inventors: Mizuho Shirakura, Yamanashi-ken (JP); Naoki Suzuki, Minamialps (JP)

(73) Assignee: Nisca Corporation, Yamanashi-Ken (JP)

( * ) Notice: Subject to any disclaimer, the term of this patent is extended or adjusted under 35 U.S.C. 154(b) by 302 days.

(21) Appl. No.: 10/611,884

(22) Filed: Jul. 3, 2003

(65) Prior Publication Data

US 2004/0056413 A1 Mar. 25, 2004

(30) Foreign Application Priority Data

Jul. 4, 2002 (JP) ..... 2002-196308

(51) Int. Cl.
*B65H 1/00* (2006.01)

(52) U.S. Cl. ..... 271/171; 271/145

(58) Field of Classification Search ..... 271/171, 271/145

See application file for complete search history.

(56) References Cited

U.S. PATENT DOCUMENTS 5,121,169 A * 6/1992 Kawabata ..... 399/389
6,014,229 A * 1/2000 Yun ..... 358/449
6,116,590 A * 9/2000 Yokoyama et al. ..... 271/171
6,805,345 B1 * 10/2004 Furukawa ..... 271/171
2004/0051234 A1 * 3/2004 Lien et al. ..... 271/171
2005/0051947 A1 * 3/2005 Furukawa ..... 271/171

OTHER PUBLICATIONS

Patent Abstracts of Japan; Publication No. 62-049344 Published on Mar. 4, 1987; Applicant: Sharp Corp.
Patent Abstracts of Japan; Publication No. 08-091745 Published on Apr. 9, 1996; Applicant: Canon Inc.
Patent Abstracts of Japan; Publication No. 07-097102 Published on Apr. 11, 1995; Applicant: Sharp Corp.

* cited by examiner

*Primary Examiner*—Eileen D. Lillis
*Assistant Examiner*—Kaitlin Joerger
(74) *Attorney, Agent, or Firm*—Manabu Kanesaka

(57) ABSTRACT

A sheet supply apparatus includes a sheet supply tray for stacking a sheet, and an auxiliary tray movable between a support position where the auxiliary tray supports a portion of the sheet stacked on the sheet supply tray and a storage position where the auxiliary tray overlaps the sheet supply tray. A sheet supply device supplies the sheet stacked on the sheet supply tray. A sheet detection device is mounted on the auxiliary tray for detecting the sheet stacked on the sheet supply tray, and a tray position detection device detects a position of the auxiliary tray between the support position and the storage position. An identifying device identifies a length of the sheet in a sheet supply direction based on detection results of the sheet detection device and the tray detection device.

16 Claims, 11 Drawing Sheets

SHEET FEEDING APPARATUS AND IMAGE FORMING APPARATUS

BACKGROUND OF THE INVENTION AND RELATED ART STATEMENT

The present invention relates to a sheet supply apparatus for sequentially supplying sheets stacked on a sheet supply tray of a copier, etc., to a predetermined position for processing, and more particularly to technology for detecting a size of the sheets stacked on the sheet supply tray.

Conventionally, a sheet supply apparatus of a sheet feeding apparatus mounted on an image forming apparatus such as a copier, a facsimile and a printer is provided with a sheet supply tray for stacking sheets, feed rollers for feeding the sheets from the sheet supply tray, and supply rollers for separating and supplying the sheets one at a time.

There is a sheet supply apparatus in which a sheet supply portion separates sheets on a sheet supply tray into a single sheet and turns the sheets over to supply to a platen, then a transport unit transports the sheets to a predetermined position on the platen for reading. After being read, the sheets are turned over again at a discharge portion to be discharged to a discharge tray.

In such a sheet supply apparatus, the sheet supply tray and discharge tray are overlapped so as to reduce an installation space as opposed to configurations in which both trays are arranged horizontally next to each other. However, it is sometimes difficult to remove the sheets on the discharge tray depending on a position of the sheet supply tray, or difficult to visually confirm the discharged sheets.

In order to resolve these problems, there has been a configuration in which an auxiliary tray is provided for supporting sheets larger than A4 or B4. The auxiliary tray can be pulled out from the sheet supply tray. The auxiliary tray is usually stored in a storage position, and pulled out when necessary.

In general, the sheet supply apparatus is provided with size sensors for detecting a size of the sheets mounted on the sheet supply tray. The size sensors detect the size of the sheets stacked on the sheet supply tray, and send a signal to a main unit such as a copier. Accordingly, it is possible to perform a preliminary operation such as supplying a copier sheet in the main unit or a preparatory operation for processing an image before reading the image on the sheets, thereby improving the processing efficiency of the overall system.

However, in the case that the size sensors are disposed on the auxiliary tray for detecting the size of the sheets, when the auxiliary tray is not completely pulled out, it is possible to detect the size incorrectly. Also, when the auxiliary tray is stored, it is not possible to detect the size of the sheets on the sheet supply tray. Therefore, the processing efficiency of the overall image forming apparatus including an image reading apparatus is decreased.

In view of the problems described above, an object of the present invention is to provide a sheet supply apparatus that can detect the size of the sheets even when the sheet supply apparatus is provided with the auxiliary tray, thereby improving the processing efficiency.

Further objects and advantages of the invention will be apparent from the following description of the invention.

SUMMARY OF THE INVENTION

In order to attain the objects described above, according to the present invention, a sheet supply tray is provided with an auxiliary tray movable between a sheet support position for supporting a portion of sheets stacked on a sheet supply tray and a storage position stored in the sheet supply tray. The sheet supply tray is also provided with tray position detection means for detecting a position of the auxiliary tray and sheet detection means disposed on the auxiliary tray, so that a length of the sheets on the sheet supply tray in a sheet supply direction is determined.

With this configuration, it is possible to accurately detect the sheet size without detecting the sheet size incorrectly when the auxiliary tray is pulled out or stored. Furthermore, because the sheet size can be accurately detected on the sheet supply tray, it is possible to improve processing efficiency of the overall image forming apparatus.

DETAILED DESCRIPTION OF PREFERRED EMBODIMENTS

Hereunder, embodiments of the invention will be explained with reference to the accompanied drawings.

Figure 1:
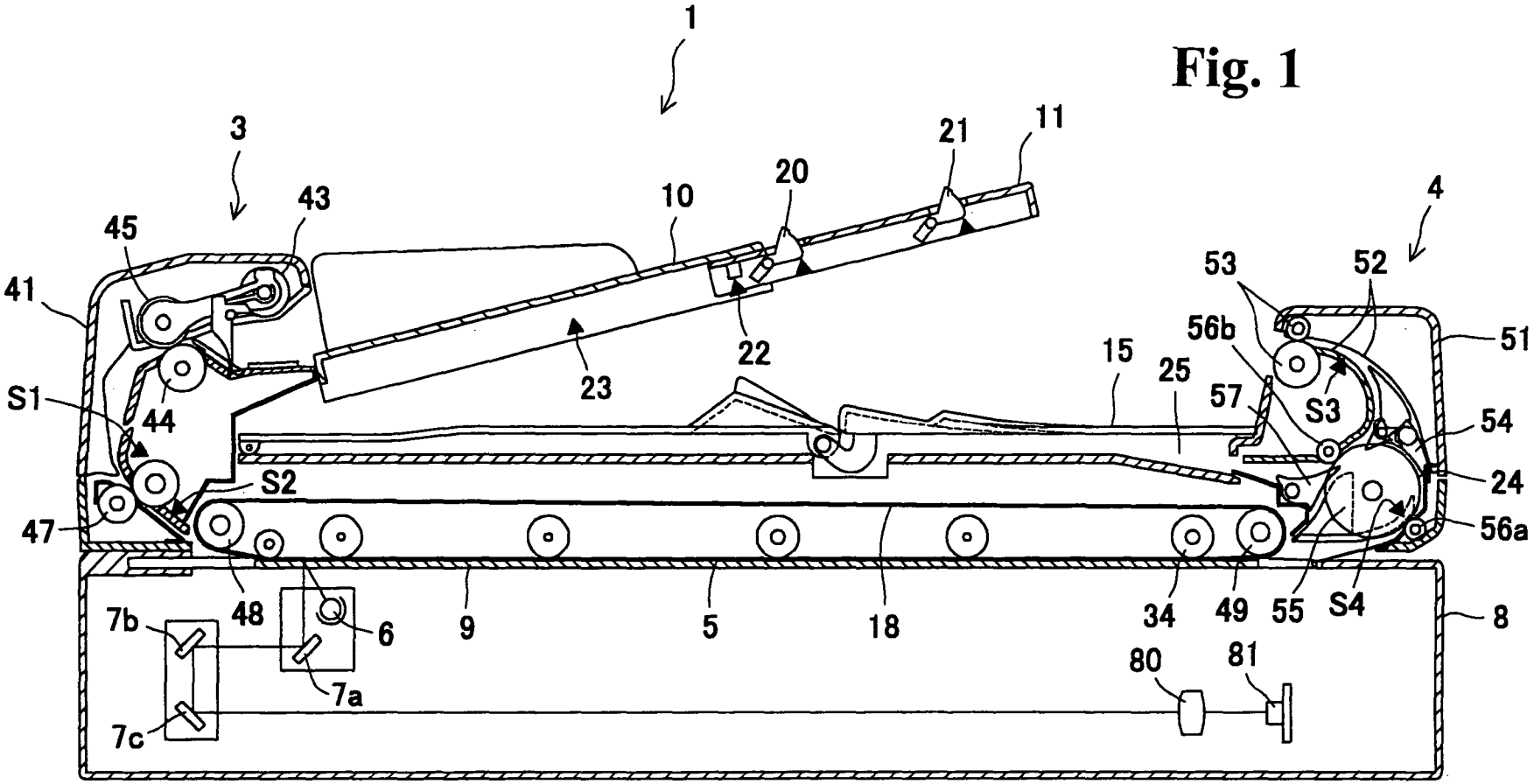
FIG. 1 is a front sectional view showing a sheet supply apparatus.

FIG. 1 is a front sectional view showing a sheet supply apparatus 1. According to the present invention, the sheet supply apparatus 1 is mounted on a reading apparatus body with a hinge, and the like (not shown) to be capable of opening and closing a platen 9 disposed on an upper portion of an image reading apparatus 8. A main unit of the image reading apparatus 8 radiates light from a light source 6 through a platen 9 onto a transported sheet. The light reflected from the sheet is reflected by a plurality of mirrors 7*a*, 7*b* and 7*c* into a reading means such as CCD 81 via a lens 80, and is photo-electrically converted to read an image on the sheet.

As shown in FIG. 1, the sheet supply apparatus 1 comprises a sheet supply tray 10 for stacking the sheets, a sheet supply portion 3 for feeding the sheets from the sheet supply tray 10, a transport portion 5 for receiving the sheets fed from the sheet supply portion 3 and transporting the sheets to a predetermined position on the platen 9 (reading position), a discharge portion 4 for discharging the sheets after reading, and a discharge tray 15 for storing the discharged sheets.

An auxiliary tray 11 is mounted to the sheet supply tray 10 and is movable relative to the same. The auxiliary tray 11 moves between a sheet supporting position where the auxiliary tray 11 supports a portion of the sheets stacked on the sheet supply tray 10, and a stored position where the auxiliary tray 11 is stored in the sheet supply tray 10.

A switchback path 25 is disposed under the discharge tray 15 for turning the sheets over fed after reading at the platen 9, then turning the sheets over again to guide the sheets into the discharge tray 15.

The sheet supply portion 3 comprises a feed roller 43 that feeds the sheets from the sheet supply tray 10, separation roller 44 that separates a plurality of stacked sheets into a single sheet, supply roller 45 that supplies the sheet, register sensor S1 that detects an edge of the sheet, a pair of register rollers 47 and timing sensor S2 that controls the supply of the sheet.

Note that a sheet supply cover 41 of this embodiment is structured to open and close freely, and the cover 41 is opened to open the sheet supply path. Thus, it is easy to remove jammed sheets.

The discharge portion 4 comprises a pair of discharge guides 52 that guide the sheet to be discharged, a pair of discharge rollers 53 that transports the sheets to the discharge tray, discharge sensor S3 that detects the edge of the original to be discharged, turn-over sensor S4 that detects that the sheet is turned over, turn-over roller 55 that turns the sheet over, discharge flapper 54 that controls the discharge path 24 for the sheets, turn-over flapper 57 that controls the turn-over of the sheets, and pinch rollers 56 *a* and 56 *b* that press the sheets against the turn over roller.

The discharge cover 51 is formed to be rotatable. The discharge path 24 and turn-over path 25 can be opened by rotating the discharge cover 51.

As shown in FIG. 1, the transport path comprises a transport belt that extends between the drive roller 48 and the follower 49. Also, a plurality of pressure rollers 34 is disposed to accurately transport the sheets to the platen 9 to perform fine readings of the images.

The rollers for the sheet supply portion 3 are connected to the sheet supply motor, those for the discharge portion 4 connected to the discharge motor, and those for the transport portion 5 are connected to the transport motor. The motors are capable of both forward and reverse rotations.

An operation of sheet transport will be explained next. First, in a case that the sheets have the images on one-side thereof, the feed roller 43 and the supply roller 45 rotate when the sheets are stacked on the sheet supply tray 10. Then, the sheets are fed by the feed roller 43 and separated into a single sheet and fed by the supply roller 45 and the separation member 44. After the leading edge of the sheet is detected by the register sensor S1, the sheet is fed for a predetermined amount to eliminate skewing in the sheet by abutting the nipping portion of the register rollers 47.

Then, by rotating the register rollers 47, the sheet is fed toward the platen 9 while the transport belt 18 is rotated. When the trailing edge of the sheet transported by the register rollers 47 and transport belt 18 is detected by the timing sensor S2, the sheet is transported just for a predetermined distance, and the register rollers 47 and transport belt 18 stop. As a result, the sheet is positioned at a predetermined position on the platen 9. Then, the reading means on the main apparatus reads the images on the sheet.

When the images on the sheet are read and that process is completed, the transport belt 18 drives forward again. Simultaneously, the turn-over roller 55 drives in forward to feed the sheet from the platen 9.

The sheet discharged from the platen 9 is guided to the switchback path 25 by the discharge flapper 54 and the turn over flapper 57. The sheet is transported by a predetermined amount after the trailing edge thereof is detected by the discharge sensor S4, and the turn over rollers stop temporarily. At this time, the trailing edge of the sheet is stopped at the nipping portion between the turn over roller 55 and the pinch roller 56*b*. Then, the turn over roller 55 is rotated in reverse to feed the sheet to the pair of discharge rollers 53 to switchback the sheet, and then discharges the sheet to the discharge tray 11.

In a case that the sheet has the images on both sides, the image on one side of the sheet is read with an operation the same as that of transporting the sheet with the images formed on one side.

Then, after reading the images on one side of the sheet, the sheet is fed from the platen 9 by the transport belt 18 and turn over roller 55.

The sheet fed from the platen 9 passes through the discharge flapper 54 and the turn over flapper, and is inverted front to back by the turn over roller 55 and the pinch roller 56*b* and fed again to the platen 9. Then, by driving the transport belt 18 in reverse, the sheet is fed to a predetermined position on the platen 9 and then stops.

At this time, the transport belt 18 is driven in reverse when the turn over sensor S4 detects the leading edge of the sheet and stops after driving for a predetermined amount. As a result, the sheet is accurately positioned at a predetermined position on the platen 9.

The backside of the sheet fed to the predetermined position on the platen 9 is read by the reading means. When reading is completed, the transport belt 18 and turn over roller 55 are rotated in forward to feed the sheet again from the platen 9.

When the leading edge of the sheet fed from the platen 9 is detected by the turn over sensor S4, the discharge flapper 54 switches to a position to guide the sheet directly to the pair of discharge rollers 53. The sheet is then fed to the pair of the discharge rollers 53. The pair of the discharge rollers 53 discharges the sheet to the discharge tray 11.

According to the present invention, the sheet supply tray 10 and the auxiliary tray 11 in the sheet feeding apparatus 1 have the following structures and perform the following operation to detect the size of the sheets.

Figure 2:
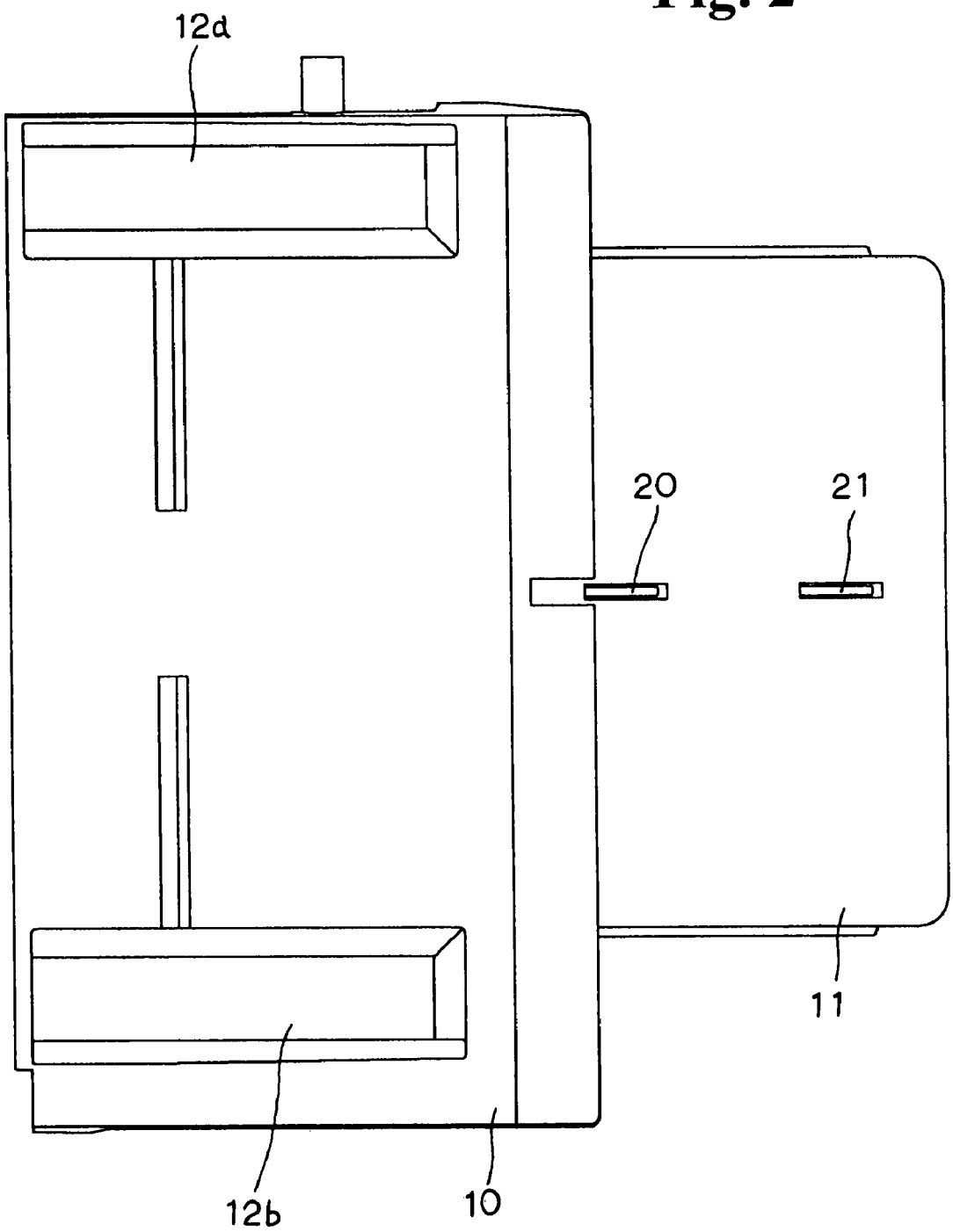
FIG. 2 is a plan view showing a state that an auxiliary tray is pulled from a sheet supply tray.
Figure 3:
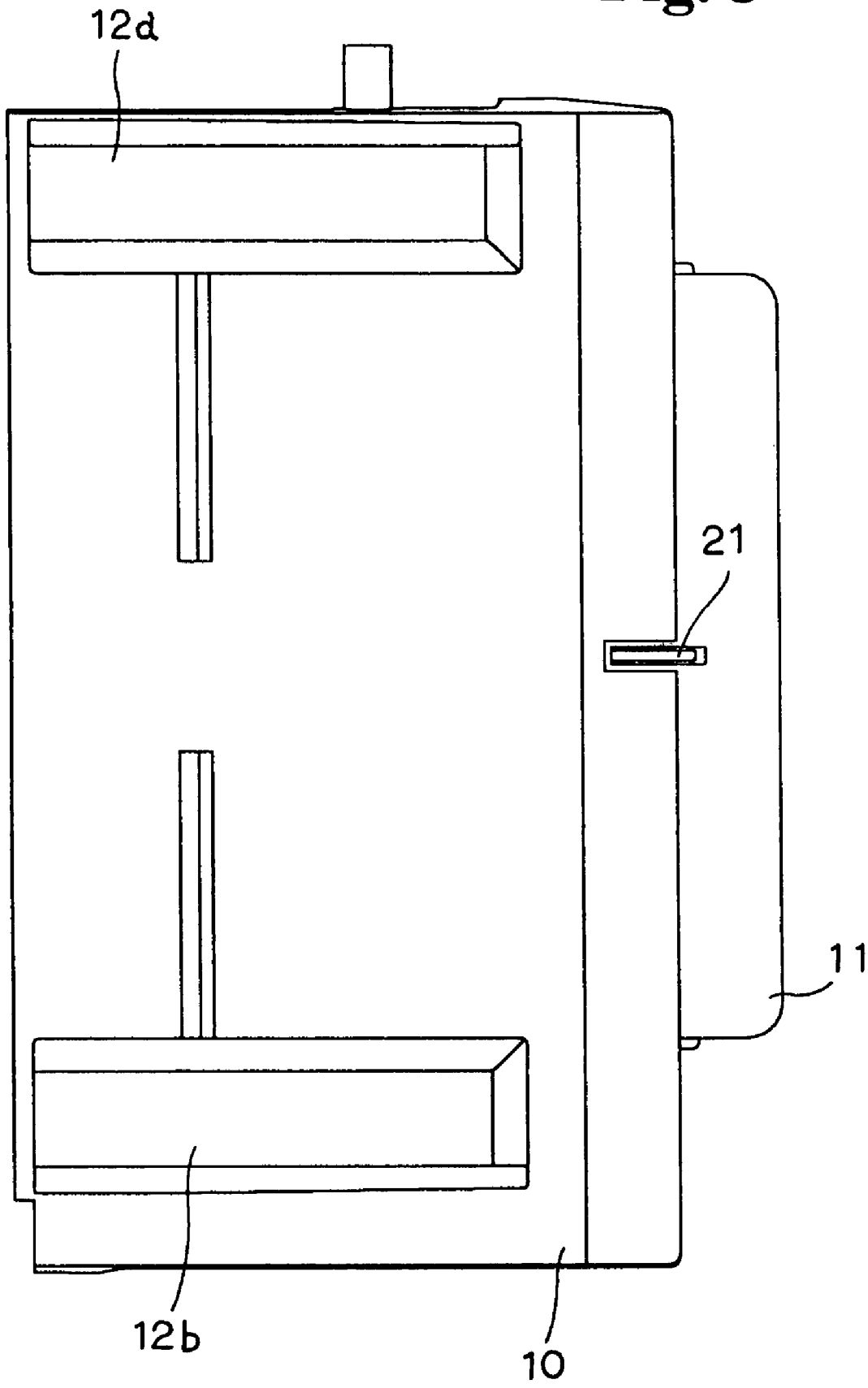
FIG. 3 is a plan view showing a state that the auxiliary tray is stored in the sheet supply tray.
Figure 4:
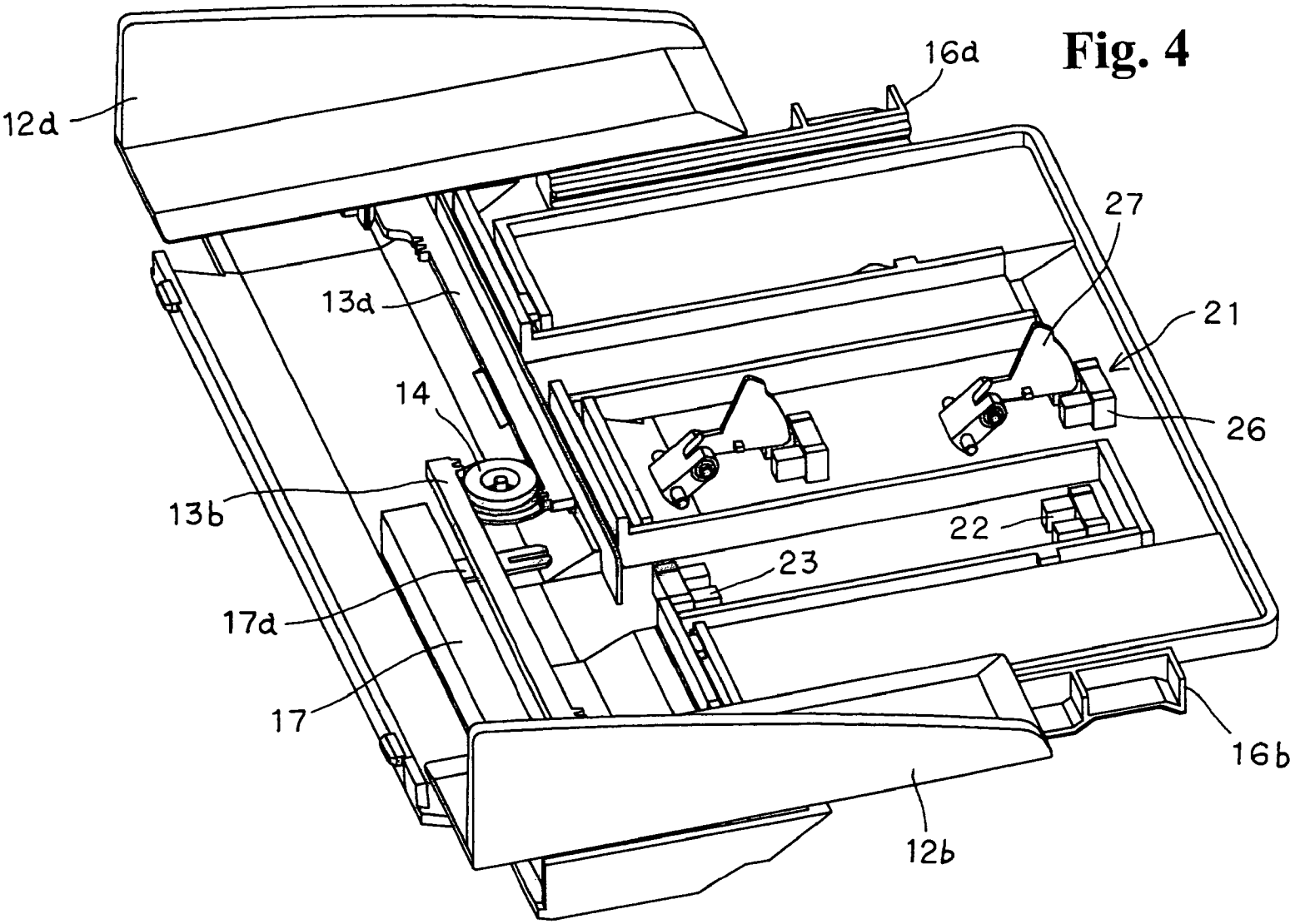
FIG. 4 is a perspective view showing a structure of the sheet supply tray.
Figure 5:
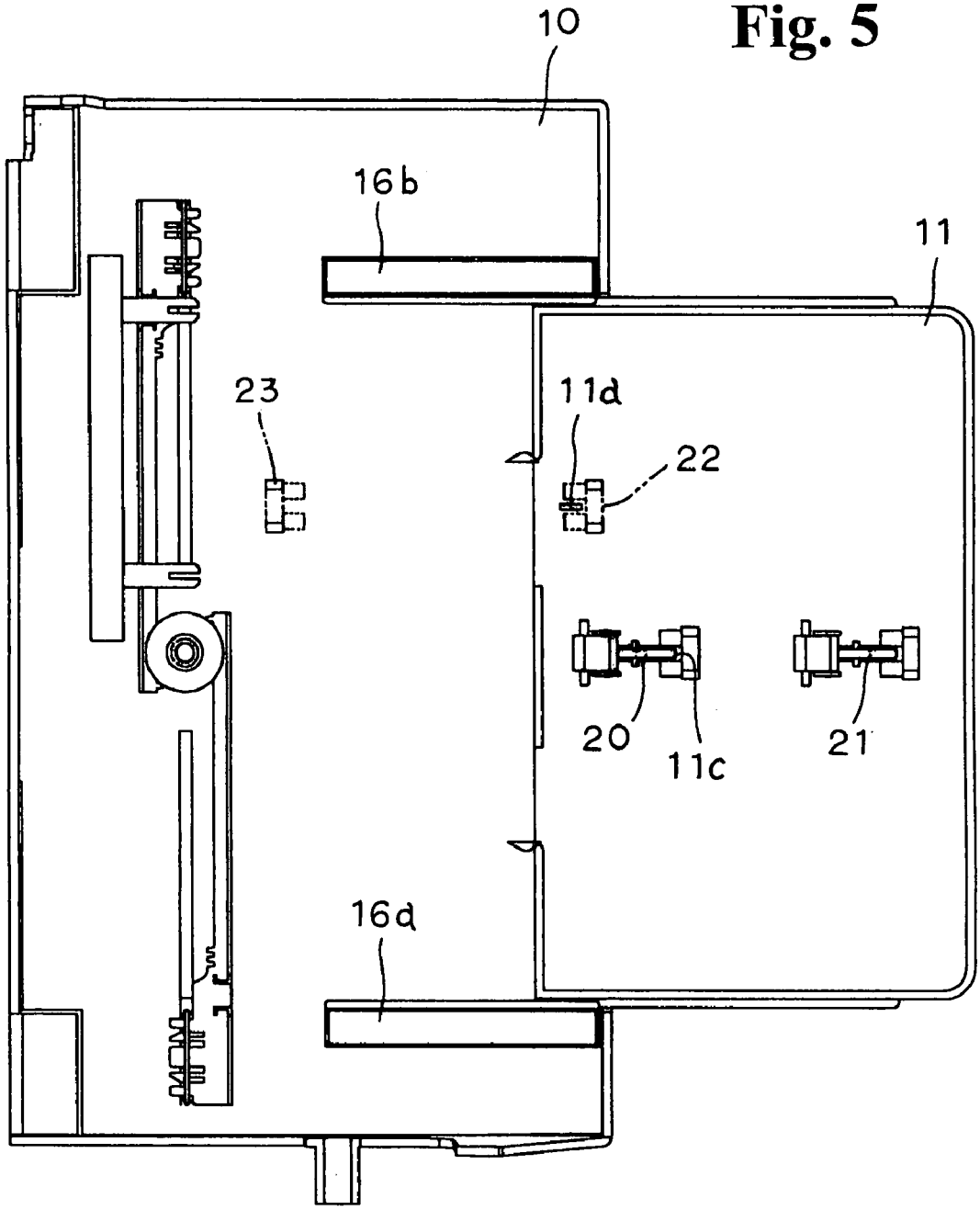
FIG. 5 is a plan view showing a rear side of the sheet supply tray shown in FIG. 2.
Figure 6:
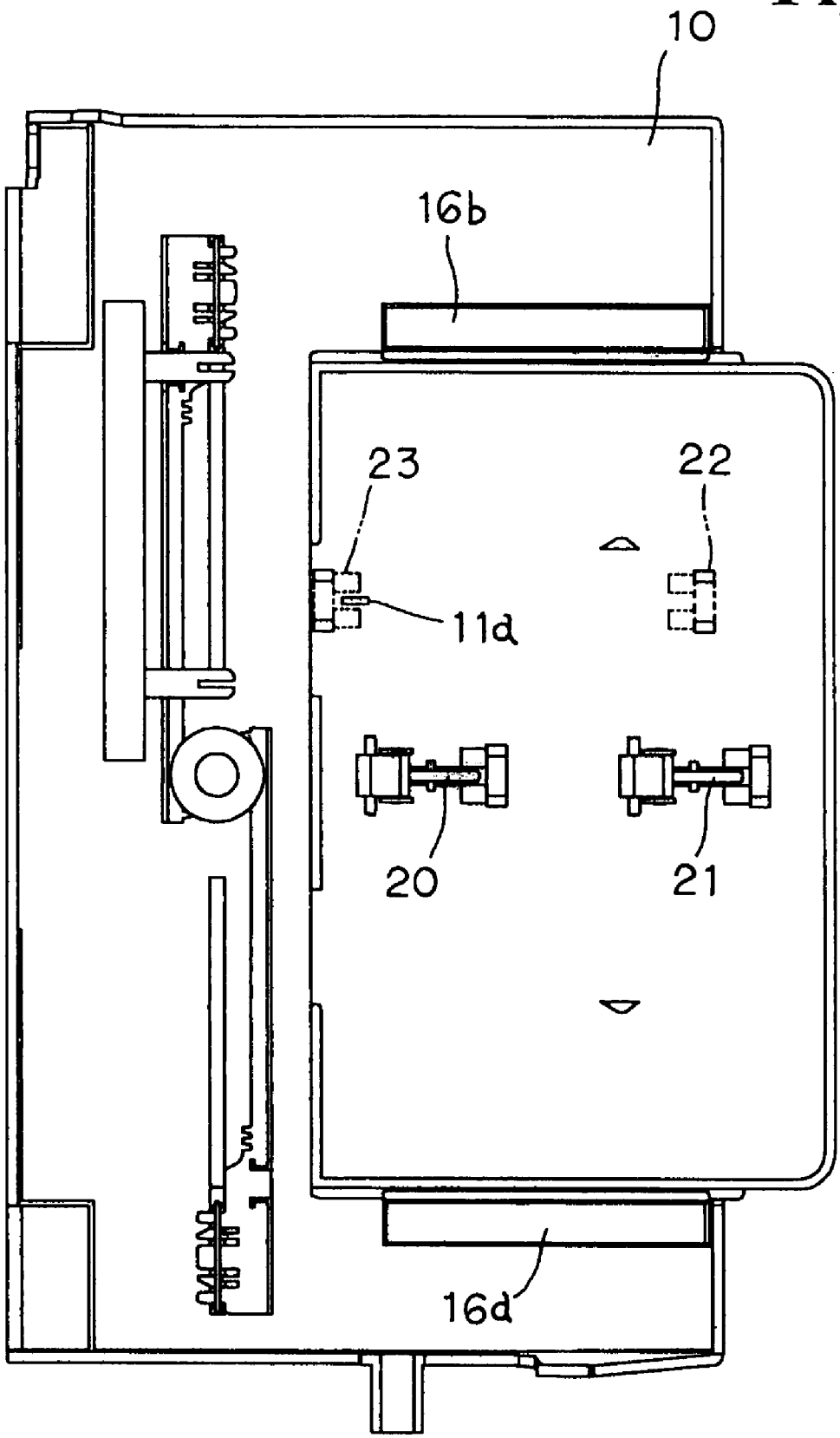
FIG. 6 is a plan view showing a rear side of the sheet supply tray shown in FIG. 4.

FIG. 2 is a plan view showing a state that the auxiliary tray 11 is pulled from the sheet supply tray 10. FIG. 3 is a plan view showing a state that the auxiliary tray 11 is stored in the sheet supply tray 10. FIG. 4 is an exploded perspective view showing a structure of the sheet supply tray 10. FIG. 5 is a plan view showing a rear side of the sheet supply tray shown in FIG. 2. FIG. 6 is a plan view showing a rear side of the sheet supply tray shown in FIG. 4.

The sheet supply tray 10 is provided with a pair of regulating guide members 12*a* and 12*b* that regulates a width direction of the sheets stacked on the sheet supply tray 10, and the auxiliary tray 11 that supports longer sized sheets, such as LG portrait, B4 portrait, A3 portrait and LD, in the supply direction.

Edges of the auxiliary tray 11 are supported by the guide rails 16*a* and 16*b* mounted on a bottom surface of the sheet supply tray 10 (see FIG. 4). The auxiliary tray 11 slides in the sheet feeding direction along the guide rails 16*a* and 16*b*.

Figure 7:
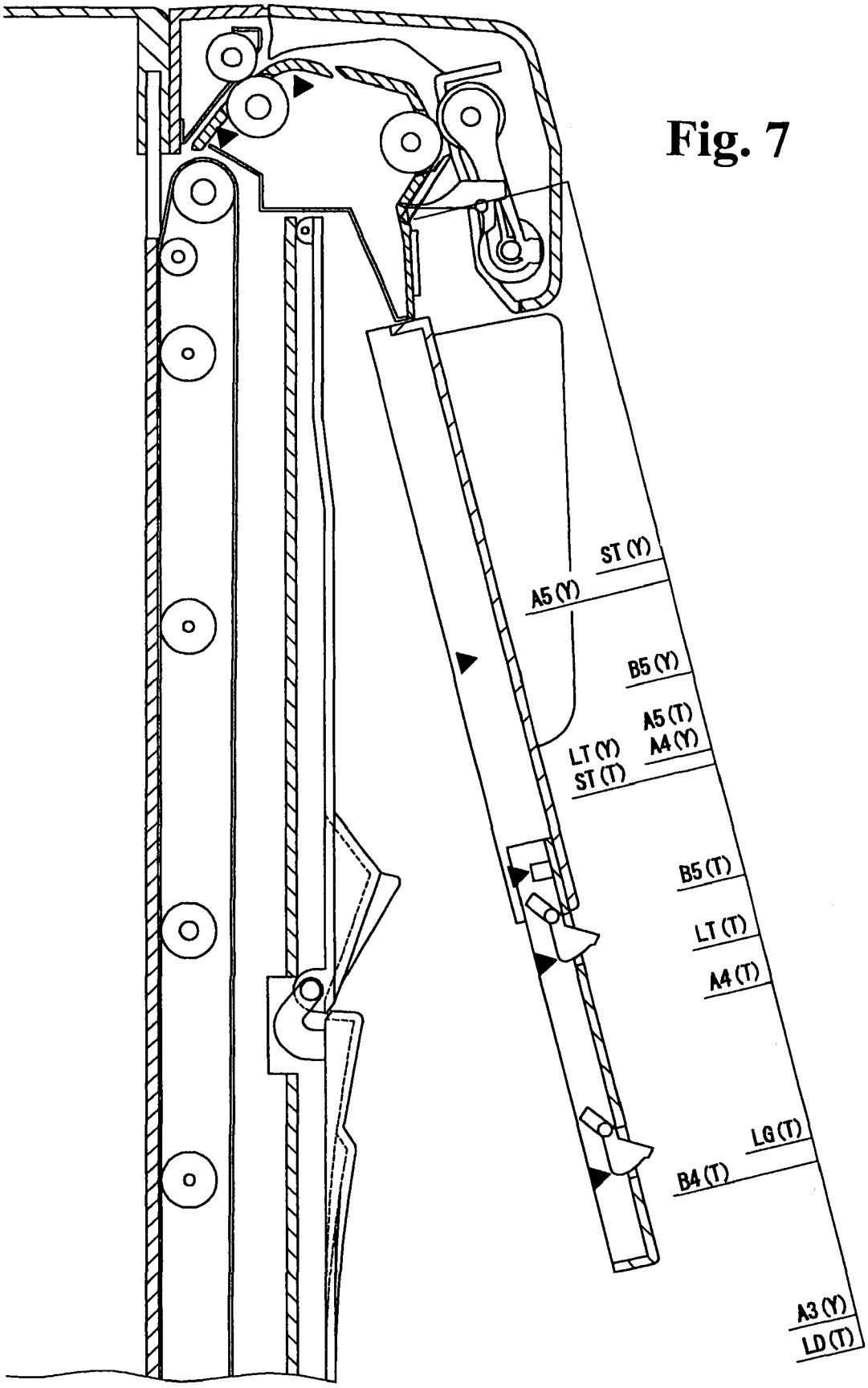
FIG. 7 shows sizes of sheets to be stacked on the sheet supply tray in the sheet supply apparatus shown in FIG. 1.

FIG. 7 is a side view of the sheet feeding apparatus shown in FIG. 1 in a state that the auxiliary tray 11 is pulled out from the sheet supply tray 10, and shows the sizes of the sheets stacked on the sheet supply tray 10. As shown in FIG. 2 and FIG. 7, in the state that the auxiliary tray 11 is pulled out from the sheet supply tray 10, the auxiliary tray 11 supports long size sheets such as LG portrait, B4 portrait, A3 portrait, and LD in conjunction with the sheet supply tray 10. As shown in FIG. 3, when the auxiliary tray 11 is stored in the sheet supply tray 10, the sheet supply tray 10 is structured to support shorter size sheets such as A4 landscape and letter, landscape in the sheet supply direction.

As shown in FIG. 5 and FIG. 6, the auxiliary tray 11 is provided with the protruding portion 11*a* for detecting the position of the auxiliary tray 11, and the sensors 23, 22 having a light emitting element and a light receiving element for detecting the position at the backside thereof.

The first position detecting sensor 22 is arranged at a position for detecting that the auxiliary tray 11 is pulled out, specifically that the auxiliary tray 11 is moved to a position to stack the long size sheets. The second position detecting sensor 23 is arranged at a position for detecting that the auxiliary tray 11 is stored, specifically that the auxiliary tray 11 is moved to a position to stack the short size sheets. With this configuration, the protruding portion 11*a* formed on the auxiliary tray 11 interrupts the light path from the light emitting element to the light receiving element of the first position detection sensor 22 at the position where the auxiliary tray 11 is pulled out. The protruding portion 11*a* also interrupts the light path from the light emitting element to the light receiving element of the second position detection sensor 23 at the position where the auxiliary tray 11 is stored.

As shown in FIG. 5 and FIG. 6, a lever type first sensor 21 and a lever type second length sensor 20 are disposed above a sheet support surface of the auxiliary tray 11 for detecting a length of the sheets.

The lever type sensors 21 and 20 comprise detection levers 27 protruding from the sheet support surface of the auxiliary tray 11, and a transmissive sensor 26 having a light emitting element and a light receiving element. When the sheets are placed on the auxiliary tray 11, the levers 27 move downward thereby interrupting the light from the light emitting element to the light receiving element of the transmissive sensor 26 disposed on the backside of the auxiliary tray 11 to detect the presence of the sheets.

The second length sensor 20 is structured to protrude from the notched portion 11*c* formed at the downstream side on the auxiliary tray 11 in the sheet transport direction when the auxiliary tray 11 is pulled out. The sensor 20 is also structured to move below the sheet supply tray 10 when pushed while the auxiliary tray 11 is stored and thus does not interfere the auxiliary tray 11 from storing.

When the auxiliary tray 11 is stored, the first length sensor 21 is arranged to move to the same position as the second length sensor 20 when the auxiliary tray 11 is pulled out. In other words, the auxiliary tray 11 is structured to move only by a distance from the second length sensor 20 to the first length sensor 21 to pull the auxiliary tray 11 from an extended position to the stored position.

As shown in FIG. 4, the pair of the alignment guide members 12*a* and 12*b* is structured to connect with each other to slide when one of the alignment guide members 12*a* and 12*b* is slid by the racks 13*a* and 13*b* and pinion 14 mounted to each of the alignment guide members 12*a* and 12*b*.

Also, the slide lever 17*a* of the slide volume 17 is mounted to the rack 13*a*. The slide lever 17*a* is displaced when the rack 13*a* moves, thereby varying a resistor value of the slide volume 17. Specifically, the output value of the slide volume 17 changes according to the amount of movement of the alignment guide member 12*b*. With that output value, in other words, by detecting the position of the alignment guide member 12*b*, the length of the sheet placed on the sheet supply tray 10 can be detected in the width direction.

Note that the first and the second length sensors and the first and the second position sensors are lever type sensors. They can also be reflective type sensors in which a light emitting unit irradiates light, and the light is reflected from an object such as a sheet, and detected by a light receiving unit.

The first and the second length sensors 21 and 20, the first and the second position sensors 22 and 23, and the slide volume 17 mounted on the sheet supply tray 10 and the auxiliary tray 11 are connected to a control board as the control means that includes a CPU. The detection results of each sensor and the output from the slide volume 17 identify the length and the width of the sheet thereby determining the sheet size.

Figure 8:
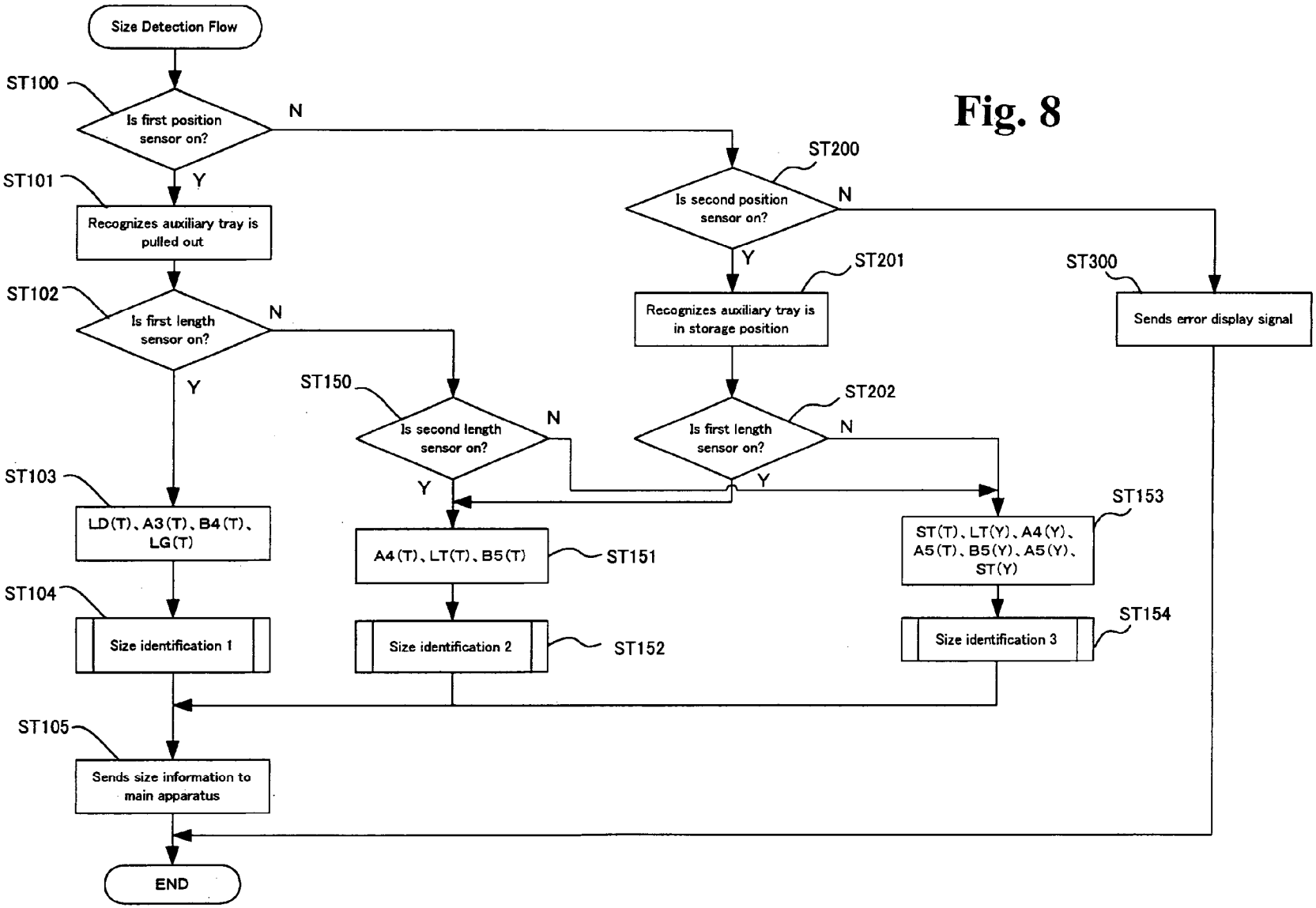
FIG. 8 is a flowchart showing a process of detecting a sheet size according to the present invention.

An operation of detecting the sheet sizes will be explained next with reference to a flowchart of the size detection. FIG. 8 is a flowchart showing the operation of the sheet size detection.

First, at ST100, it is determined whether the first position sensor 22 is ON. If it is ON at this point, it is determined that the auxiliary tray 11 is at the pulled out position (ST101). If it is OFF, it is determined whether the second position sensor 23 is ON (ST200). If the second position sensor 23 is ON, it is determined that the auxiliary tray 11 is in the storage position (ST201). If it is OFF, the auxiliary tray 11 is in neither the pulled out nor the storage position. In other words, it is determined that the auxiliary tray 11 is not at an appropriate position between the pulled out position and the stored position, so that the user is notified through an operation panel on the main unit (ST300).

When the first position sensor 22 is ON, or in other words, when the auxiliary tray 11 is at the pulled out position, the first length sensor 21 detects the sheets (ST102). If the first length sensor 21 does detect the sheets, size identification No. 1 is executed to determine (ST103) if the size of the sheets on the sheet supply tray 10 is LG portrait (hereinafter portrait is referred to as (T)), B4 (T), A3 (T) or LD (T).

If the first length sensor 21 does not detect the sheets, the second length sensor 20 detects the sheets (ST150). If the second length sensor 20 detects the sheets, the size identification No. 2 is executed to determine (ST151) whether the size of the sheets on the sheet supply tray 10 is B5 (T), LT (T) or A4 (T). If the second length sensor 20 detects the sheets, size identification No. 3 is executed to determine (ST152) whether the size of the sheets stacked on the sheet supply tray 10 is ST landscape (hereinafter landscape is referred to as (Y)), A5 (Y), B5 (Y), A5 (T) A4 (Y), LT (Y) or ST (T).

When the second position sensor 22 is ON, or in other words, when the auxiliary tray 11 is recognized to be in the stored position, the first length sensor 21 detects the sheets (ST202). If the first length sensor 21 does detect the sheets, the size identification No. 2 is executed to determine (ST151) if the size of the sheets on the sheet supply tray 10 is B5 (T), LT (T) or A4 (T). If the first length sensor 21 does not detect the sheets, the size identification No. 3 is executed to determine (ST153) whether the size of the sheets stacked on the sheet supply tray 10 is ST (Y), A5 (Y), B5 (Y), A5 (T) A4 (Y), LT (Y) or ST (T).

Table 1 shows the sheet sizes and sizes of the threshold in the width information. Table 2 shows states and sheet identification sizes of the first and the second length sensors 21 and 20 when the auxiliary tray 11 is pulled out. Table 3 shows states and sheet identification sizes of the first and the second length sensors 21 and 20 when the auxiliary tray 11 is stored.

TABLE 1

(Sheet Size)

| Sheet Size | Dimensions: Length in the Feed Direction | Dimensions: Width in the Feed Direction | Threshold (Width Information) |
|---|---|---|---|
| A3 (T) | 420 mm | 297 mm | ~288 mm |
| LD (T) | 431.8 mm | 279.4 mm | 288 mm~268 mm |
| B4 (T) | 364 mm | 257 mm | 268 mm~237 mm |
| LG (T) | 355.6 mm | 215.9 mm | 237 mm~ |
| LT (T) | 279.4 mm | 215.9 mm | ~213 mm |
| A4 (T) | 297 mm | 210 mm | 213 mm~196 mm |
| B5 (T) | 257 mm | 182 mm | 196 mm~ |
| A4 (Y) | 210 mm | 297 mm | ~288 mm |
| LT (Y) | 215.9 mm | 279.4 mm | 288 mm~268 mm |
| B5 (Y) | 182 mm | 257 mm | 268 mm~237 mm |
| ST (Y) | 139.7 mm | 215.9 mm | 237 mm~213 mm |
| A5 (Y) | 148 mm | 210 mm | 213 mm~179 mm |
| A5 (T) | 210 mm | 148 mm | 196 mm~144 mm |
| ST (T) | 215.9 mm | 139.7 mm | 144 mm~ |

TABLE 2

(Auxiliary tray When Pulled Out)

| First Length Sensor | Second Length Sensor | Judged Size |
|---|---|---|
| OFF | OFF | ST (Y), A5 (Y), B5 (Y), A5 (T), A4 (Y), LT (Y), ST (Y) |
| ON | OFF | B5 (T), LT (T), A4 (T) |
| ON | ON | LG (T), B4 (T), A3 (T), LD (T) |

TABLE 3

(Auxiliary tray When Stored)

| First Length Sensor | Second Length Sensor | Judged Size |
|---|---|---|
| X | OFF | ST (Y), A5 (Y), B5 (Y), A5 (T), A4 (Y), LT (Y), ST (Y) |
| X | ON | B5 (T), LT (T), A4 (T) (LD (T), B4 (T), A3 (T)) |

Specifically, as shown in Table 2 and in Table 3, the second position sensors 22 and 23 and the first and the second length sensors 21 and 20 determine the sheet size and obtain information according to the sheet width sizes.

After the sheets are classified into the different width sizes, the sizes of the sheets are further determined by either of the sheet size identifications of No. 1 to No. 3, which are described below. The identified sheet size information is sent (ST105) to the main apparatus such as an image forming apparatus.

In the sheet size identification processes of No. 1 to No. 3 for determining the sheet sizes, the sheet sizes are specified by the sheet width information detected by the output value of the slide volume 17 that is varied according to the movement of the alignment guide members 12*a* and 12*b*.

Figure 9:
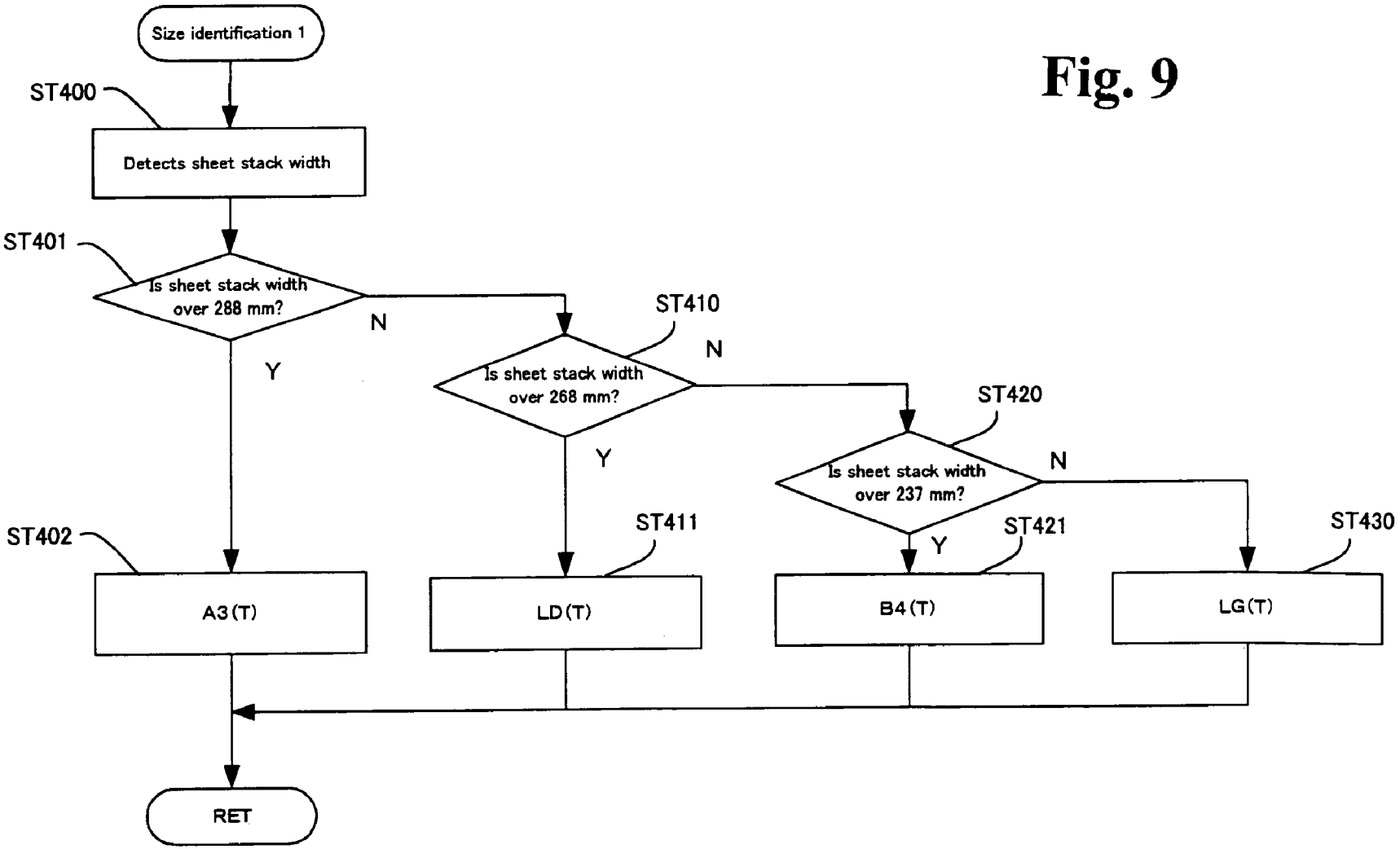
FIG. 9 is a flowchart showing a process of size identification No. 1.
Figure 10:
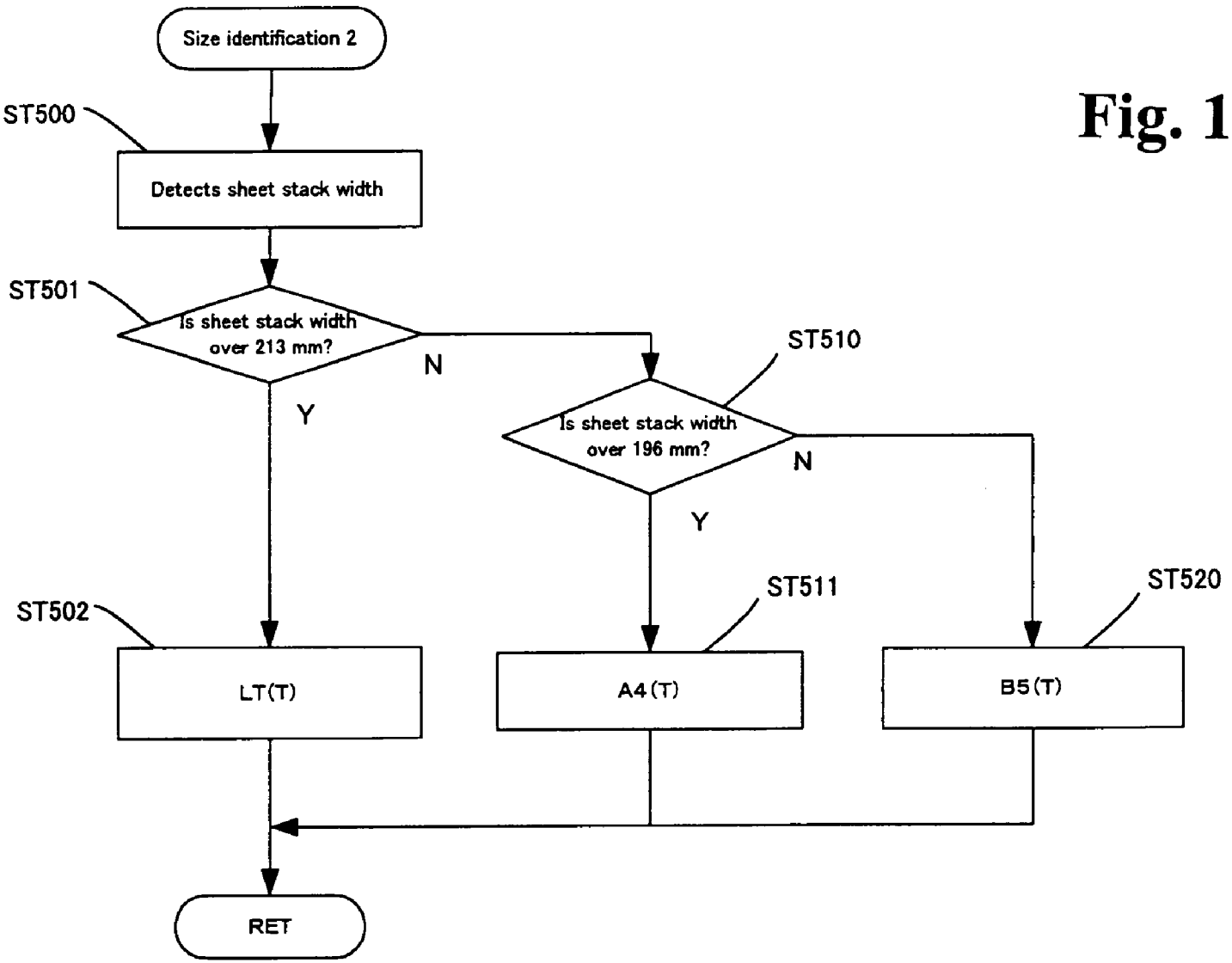
FIG. 10 a flowchart showing a process of size identification No. 2.
Figure 11:
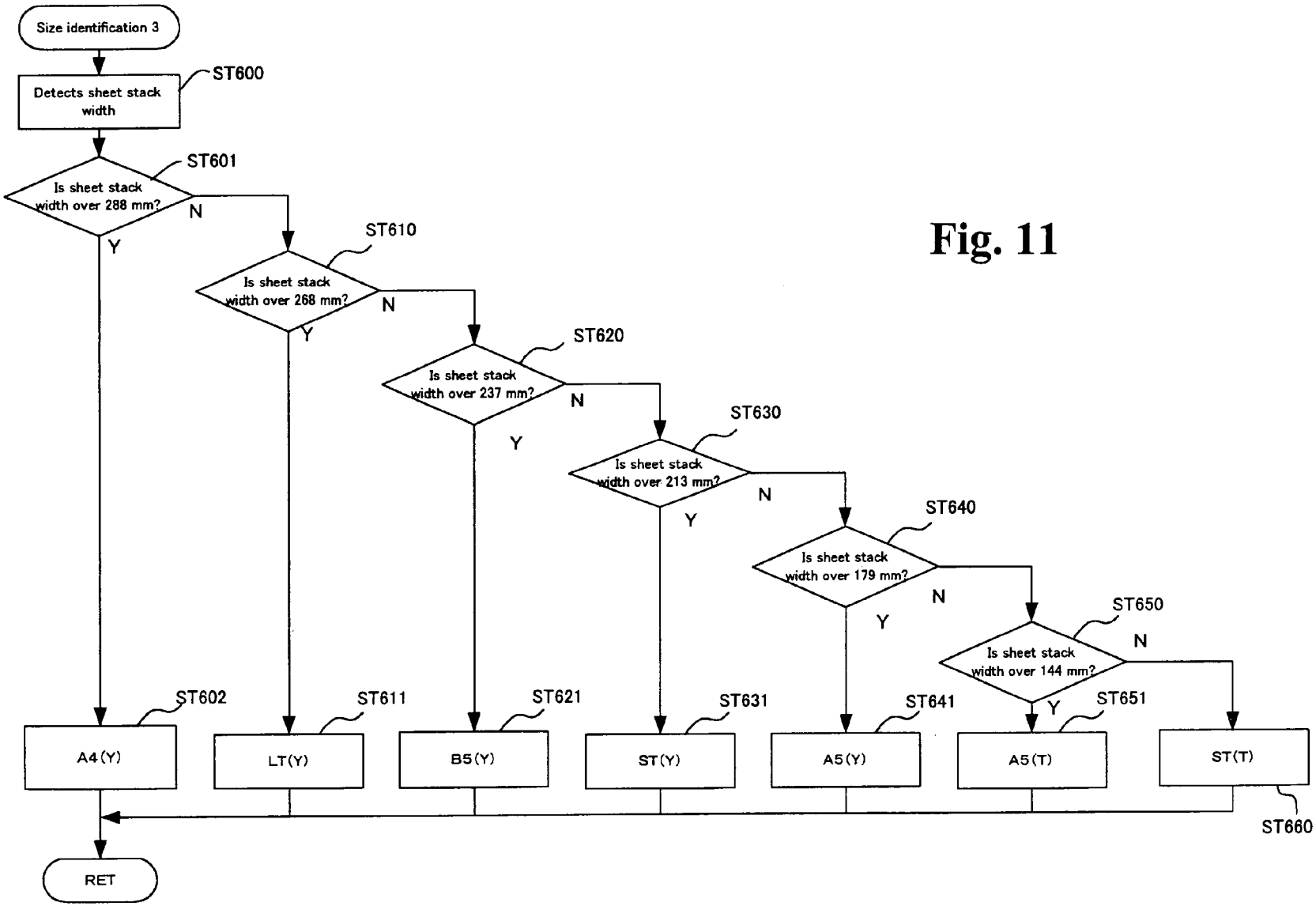
FIG. 11 is a flowchart showing a process of size identification No. 3.

A process of determining the sheet sizes will be explained next with reference to the flow charts shown in FIG. 9 to FIG. 11. FIG. 9 is a flowchart of a process of the size identification No. 1. FIG. 10 is a flowchart of a process of the size identification No. 2. FIG. 11 is a flowchart of a process of the size identification No. 3.

First, as shown in the flowchart of FIG. 9, when it is determined that the sheets stacked on the sheet supply tray 10 are either LG (T), B4 (T), A3 (T), or LD (T) (the sheet size identification No. 1) (ST400), the sheet width according to the output value of the slide volume 17 is compared as to whether it is larger than 288 mm. If the sheet width is larger than 288 mm, the sheet size is determined to be A3 (T) (ST402). Then, if the sheet width is smaller than 288 mm, it is compared to whether it is larger than 277 mm (ST410). If the sheet width is larger than 277 mm, then it is determined that the sheet size is LD (T) (ST411). Then, if the sheet width is smaller than 277 mm, it is compared to whether it is larger than 237 mm (ST420) If the sheet width is larger than 237 mm, then it is determined that the sheet size is LG (T) (ST430).

Note that the value of 288 mm is a central value between 297 mm length in the width direction for A3 (T) and 279.4 mm length in the width direction for LD (T). This is a predetermined threshold for identifying A3 (T) and LD (T). The threshold is set for each sheet size, as indicated in table 1. The size of the sheet is determined by sequentially comparing the threshold with the detected sheet width.

Next, as shown in FIG. 10, when it is determined that the sheets stacked on the sheet supply tray 10 are either A4 (T), LT (T), or B5 (T), (the sheet size identification No. 2) (ST500), the sheet width according to the output value of the slide volume 17 is compared (ST501) as to whether it is larger than 213 mm. If the sheet width is larger than 213 mm, the sheet size is determined to be LT (T) (ST502). Then, if the sheet width is smaller than 213 mm, it is compared to whether it is larger than 196 mm (ST510). If the sheet width is larger than 196 mm, it is determined that the sheet size is A4 (T) (ST511). Also, if the sheet width is smaller than 196 mm, it is determined that the sheet is B5 (T) size (ST520).

Note that the value of 213 mm is a central value between 215.9 mm length in the width direction for LT (T) and 210 mm length in the width direction for A4 (T). This is a predetermined threshold for determining A3 (T) and LD (T). The threshold is set for each sheet size, as indicated in table 1. The size of the sheet is determined by sequentially comparing the threshold with the detected sheet width.

In the sheet size identification No. 3, the threshold set for each sheet size and the detected width direction are sequentially compared, as shown in FIG. 11, to determine the size of the sheets of ST (Y), A5 (Y), B5 (Y), A5 (T) A4 (Y), LT (Y) or ST (T).

As shown in the flowchart of FIG. 11, when it is identified that the sheets stacked on the sheet supply tray 10 are either ST (Y), A5 (Y), B5 (Y), A5 (T), A4 (Y), LT (Y), or ST (T) (the sheet size identification No. 3) (ST600), the sheet width according to the output value of the slide volume 17 is compared (ST601) as to whether it is larger than 288 mm. If the sheet width is larger than 288 mm, then the sheet size is determined to be A4 (Y) (ST602). Then, if the sheet width is smaller than 288 mm, it is compared to whether it is larger than 268 mm (ST610). If the sheet width is larger than 268 mm, it is determined that the sheet size is LT (Y) (ST611).

Then, if the sheet width is smaller than 268 mm, it is compared to whether it is larger than 237 mm (ST510). If the sheet width is larger than 237 mm, it is determined that the sheet size is B5 (Y) (ST621). If the sheet width is smaller than 237 mm, it is compared to whether it is larger than 213 mm (ST630). If the sheet width is larger than 213 mm, it is determined that the sheet size is ST (Y) (ST631). If the sheet width is smaller than 213 mm, it is compared to whether it is larger than 179 mm (ST640). If the sheet width is larger than 179 mm, it is determined that the sheet size is A5 (Y) (ST641) If the sheet width is smaller than 179 mm, it is compared to whether it is larger than 144 mm (ST650). If the sheet width is larger than 144 mm, it is determined that the sheet size is A5 (T) (ST651). Also, if the sheet width is smaller than 144 mm, it is determined that the sheet is B5 (T) size (ST660).

Note that in the invention described above, once the sheet size is classified according to the results of the detection of the sheet length, the size of the sheet is determined based on the results of the detection of the sheet width. However, it is also perfectly acceptable to classify the sheet size according to the sheet width and to determine the sheet size based on the detection results from the length of the sheet.

Also, in the invention described above, two length sensors are disposed to detect the length of the sheet, but it is also perfectly acceptable to arrange three or more length sensors lined up in the sheet transport direction. This configuration makes it possible to obtain even more detailed information relating to the sheet length.

Still further, it is conceivable to dispose three or more position sensors to detect the position of the auxiliary tray 11. This configuration enables detection of the sheet size when the auxiliary tray 11 is pulled out or when it is half-way stored. In such a case, no warning display is required for the user and the handling of the auxiliary tray is easier.

As described in detail above, according to the present invention, the sheet feeding apparatus comprises the sheet supply tray that stacks the sheets, the auxiliary tray that is mounted to move between the supporting position that supports the portion of the sheets stacked on the sheet supply tray and the storage position where it is stored in the sheet supply tray, and the sheet supply means for supplying sheets stacked on the sheet supply tray. By providing the sheet detecting means on the auxiliary tray that detect the sheets stacked on the sheet supply tray, the tray position detecting means for detecting the position of the auxiliary tray, and the sheet identification means for identifying the length of the sheet in the sheet supply direction based on the detection results of the sheet detecting means and sheet tray position detecting means, it is possible to accurately determine the size of the sheets placed on the sheet supply tray in the sheet supply apparatus equipped with the auxiliary tray. This also improves the sheet processing efficiency of the image forming apparatus that includes the image reading apparatus.

While the invention has been explained with reference to the specific embodiments of the invention, the explanation is illustrative and the invention is limited only by the appended claims.

What is claimed is:

1. A sheet supply apparatus for supplying a sheet, comprising:

a sheet supply tray for stacking the sheet;

an auxiliary tray movably attached to the sheet supply tray to move between a support position where the auxiliary tray supports a portion of the sheet stacked on the sheet supply tray and a storage position where the sheet supply tray overlaps the auxiliary tray;

sheet supply means situated adjacent to the sheet supply tray for supplying the sheet stacked on the sheet supply tray;

sheet detection means mounted on the auxiliary tray and having detection positions changed by a movement of the auxiliary tray, said sheet detecting means detecting presence or absence of the sheet stacked on the auxiliary tray;

tray position detection means for detecting a position of the auxiliary tray between the support position and the storage position; and identifying means electrically connected to the sheet detection means and the tray position detection means for identifying a length of the sheet in a sheet supply direction based on detection results of the sheet detection means and the tray position detection means.

2. A sheet supply apparatus according to claim 1, further comprising sheet width detection means for detecting a width of the sheet in a direction perpendicular to the sheet supply direction; and determining means electrically connected to the identifying means and the sheet width detection means for determining a size of the sheet based on the length of the sheet in the sheet supply direction determined by the identifying means and the width of the sheet detected by the sheet width detection means.

3. A sheet supply apparatus according to claim 2, wherein said sheet width detection means is disposed on the sheet supply tray for detecting the width of the sheet stacked on the sheet supply tray.

4. A sheet supply apparatus according to claim 1, wherein said tray position detection means includes a first tray position sensor for detecting the auxiliary tray at the support position, and a second tray position sensor for detecting the auxiliary tray at the storage position.

5. A sheet supply apparatus according to claim 1, wherein said sheet detection means is arranged at a position where the sheet detection means detects the sheet having a length longer than a first length when the auxiliary tray is positioned at the support position, and where the sheet detection means detects the sheet having a length longer than a second length and shorter than the first length when the auxiliary tray is positioned at the storage position.

6. A sheet supply apparatus according to claim 5, wherein said identifying means determines that the sheet has a length longer than the first length when the tray position detection means detects the auxiliary tray at the support position and the sheet detection means detects the sheet, and determines that the sheet has a length longer than the second length and shorter than the first length when the tray position detection means detects the auxiliary tray at the storage position and the sheet detection means detects the sheet.

7. A sheet supply apparatus according to claim 1, further comprising signal generation means for generating an error signal when the tray position detection means detects the auxiliary tray at a position different from the support position and the storage position.

8. A sheet supply apparatus for supplying a sheet, comprising:

a sheet supply tray for stacking the sheet;

an auxiliary tray movably attached to the sheet supply tray to move between a support position where the auxiliary tray supports a portion of the sheet stacked on the sheet supply tray and a storage position where the sheet supply tray overlaps the auxiliary tray;

sheet supply means situated adjacent to the sheet supply tray for supplying the sheet stacked on the sheet supply tray;

tray position detection means for detecting a position of the auxiliary tray between the support position and the storage position;

first sheet detection means mounted on the auxiliary tray for detecting the sheet stacked on the sheet supply tray;

second sheet detection means mounted on the auxiliary tray at a downstream side relative to the first sheet detection means in a sheet supply direction for detecting the sheet stacked on the sheet supply tray; and identifying means electrically connected to the first and second sheet detection means and the tray position detection means for identifying a length of the sheet in the sheet supply direction based on detection results of the first and second sheet detection means and the tray position detection means, wherein said identifying means determines the length of the sheet stacked on the sheet supply tray in the sheet supply direction by detection results of the first sheet detection means and the second sheet detection means when the tray position detection means detects the auxiliary tray at the support position, and by detection result of the first sheet detection means when the tray position detection means detects the auxiliary tray at the storage position.

9. A sheet supply apparatus according to claim 8, wherein said identifying means invalidates the detection result of the second sheet detection means when the tray position detection means detects the auxiliary tray at the storage means.

10. A sheet supply apparatus according to claim 9, further comprising signal generation means for generating an error signal when the tray position detection means detects the auxiliary tray at a position different from the support position and the storage position.

11. A sheet supply apparatus according to claim 8, further comprising sheet width detection means for detecting a width of the sheet in a direction perpendicular to the sheet supply direction; and determining means electrically connected to the identifying means and the sheet width detection means for determining a size of the sheet based on the length of the sheet in the sheet supply direction determined by the identifying means and the width of the sheet detected by the sheet width detection means.

12. An image reading apparatus for reading the sheet with an image formed thereupon, comprising: the sheet supply apparatus according to claim 1; reading means for reading the image on the sheet fed to a reading position by the sheet supply means; discharge means for discharging the sheet read at the reading position; a discharge tray for storing the sheet discharged by the discharge means; sheet width detection means for detecting a width of the sheet in a direction perpendicular to the sheet supply direction; and determining means for determining a size of the sheet based on the length of the sheet in the sheet supply direction identified by the identifying means and the width of the sheet detected by the sheet width detection means.

13. An image reading apparatus according to claim 12, wherein said sheet width detection means is disposed on the sheet supply tray for detecting the width of the sheet stacked on the sheet supply tray.

14. An image reading apparatus according to claim 13, further comprising transmission means for transmitting information regarding the size of the sheet determined by the determining means to an external device before at least the reading means reads the image on the sheet.

15. A sheet supply apparatus according to claim 8, wherein said first and second sheet detection means are arranged such that a position of the first sheet detection means when the auxiliary tray is located in the storage position is substantially same as a position of the second sheet detection means when the auxiliary tray is located in the support position.

16. A sheet supply apparatus according to claim 8, wherein said first and second sheet detecting means detect presence or absence of the sheet stacked on the auxiliary tray.

* * * * *